US009726372B2

(12) United States Patent
Asikkala et al.

(10) Patent No.: US 9,726,372 B2
(45) Date of Patent: Aug. 8, 2017

(54) BURNER NOZZLE, BURNER AND A SURFACE TREATMENT DEVICE

(71) Applicant: BENEQ OY, Vantaa (FI)

(72) Inventors: Kai Asikkala, Vantaa (FI); Tuomo Määttä, Vantaa (FI); Simo Tammela, Vantaa (FI)

(73) Assignee: BENEQ OY, Vantaa (FI)

( * ) Notice: Subject to any disclaimer, the term of this patent is extended or adjusted under 35 U.S.C. 154(b) by 128 days.

(21) Appl. No.: 14/897,593

(22) PCT Filed: Jun. 10, 2014

(86) PCT No.: PCT/FI2014/050467

§ 371 (c)(1),
(2) Date: Dec. 10, 2015

(87) PCT Pub. No.: WO2014/199015

PCT Pub. Date: Dec. 18, 2014

(65) Prior Publication Data

US 2016/0123581 A1 May 5, 2016

(30) Foreign Application Priority Data

Jun. 14, 2013 (FI) ..... 20135655

(51) Int. Cl.
*F23D 14/02* (2006.01)
*F23D 14/82* (2006.01)
(Continued)

(52) U.S. Cl.
CPC ..... *F23D 14/82* (2013.01); *F23D 14/02* (2013.01); *F23D 14/56* (2013.01); *F23D 14/583* (2013.01); *F23D 14/62* (2013.01)

(58) Field of Classification Search
CPC ..... F23D 14/82; F23D 14/56; F23D 14/583; F23D 14/62; F23D 14/02; F23C 7/00; F23K 2900/05004
(Continued)

(56) References Cited

U.S. PATENT DOCUMENTS 713,449 A * 11/1902 Keiser ..... F23D 14/82 431/110
2,715,648 A * 8/1955 Lehrer ..... C07C 11/24 431/346
(Continued)

FOREIGN PATENT DOCUMENTS

JP 55012333 A * 1/1980 ..... F23C 7/00
JP S55111862 A 8/1980
(Continued)

*Primary Examiner* — Gregory Huson
*Assistant Examiner* — Daniel E Namay
(74) *Attorney, Agent, or Firm* — Procopio, Cory, Hargreaves & Savitch LLP

(57) ABSTRACT

A burner nozzle is disclosed, comprising a nozzle body that includes a slit such that a line passage to the slit opens in an outlet face surface at the surface of the burner nozzle body. A plurality of channels is connected to the slit. A group of first channels is connected to a source of oxidizing substance, and a group of second channels is connected to a fuel source. Each of the first channels and second channels have a circumferential passage to the slit at a non-zero distance from the outlet face surface. Furthermore, each of the first channels and second channels is formed to output a directed tubular flow towards a side wall of the slit, or towards a circumferential passage in a side wall of the slit. A safe pre-mixed burner configuration is achieved. A burner and a surface treatment device incorporating the burner nozzle are also disclosed.

22 Claims, 5 Drawing Sheets

(51) Int. Cl.

| | |
|---|---|
| ***F23D 14/56*** | (2006.01) |
| ***F23D 14/62*** | (2006.01) |
| ***F23D 14/58*** | (2006.01) |
| *F23C 7/00* | (2006.01) |
| *F23K 5/00* | (2006.01) |

(58) Field of Classification Search
USPC ..... 431/346, 176, 175, 181
IPC ..... F23D 14/02,14/82, 14/56, 14/62; F23C 7/00; F23K 5/00
See application file for complete search history.

(56) References Cited

U.S. PATENT DOCUMENTS

| | | | | | |
|---|---|---|---|---|---|
| 4,900,244 | A * | 2/1990 | Keller | F23G 7/08 | 431/202 |
| 6,082,310 | A * | 7/2000 | Valcic | F23D 14/72 | 122/13.01 |
| 8,192,195 | B2 * | 6/2012 | Borders | F23D 14/20 | 431/10 |
| 9,182,119 | B2 * | 11/2015 | Mach | F23D 14/145 | |
| 2007/0141522 | A1 * | 6/2007 | Borders | F23D 14/20 | 431/354 |
| 2009/0233000 | A1 | 9/2009 | Wang | | |
| 2012/0164590 | A1 * | 6/2012 | Mach | F23D 14/145 | 431/328 |

FOREIGN PATENT DOCUMENTS

| | | | | | |
|---|---|---|---|---|---|
| JP | 62052312 | A * | 3/1987 | | |
| JP | 62125211 | A * | 6/1987 | A62C 2/04 | |
| JP | 03129204 | A * | 6/1991 | | |
| JP | 2003106505 | A * | 4/2003 | F23D 14/42 | |

* cited by examiner

BURNER NOZZLE, BURNER AND A SURFACE TREATMENT DEVICE

FIELD OF THE INVENTION

The present invention relates to a burner nozzle, a burner and a surface treatment device according to preambles of the independent claims.

BACKGROUND ART

In the context of burners, fuels refer to fluids that store energy in forms that can be practicably released in exothermic reactions into heat energy. A burner is a device or a device arrangement by means of which these exothermic processes can be applied in a controlled combustion process.

A burner typically includes a nozzle that has an input for a fuel and for an oxidizing substance, and a carefully designed configuration of channels by means of which the fuel and the oxidizing substance are mixed into a combustible mixture and released into a combustion zone in front of the nozzle. Burners are usually divided into two main types, pre-mixed burners and post-mixed burners. In a pre-mixed burner the fuel and the oxidizing substance are completely mixed before they are discharged into the combustion zone. A post-mixed burner is one in which the fuel and oxidizing substance are kept separate until they are separately discharged into the combustion zone. A category of post-mixed burners is partially-aerated burners in which only a portion of the stoichiometric oxygen quantity that is necessary for complete combustion is mixed with the fuel before entry into the combustion zone. Additional secondary oxygen enters the flame after ignition to complete the process.

Pre-mixed burners are typically more effective, provide a more consistent flame than post-mixed burners, and for these advantages would be preferred in many application areas. For example, in surface treatment devices, pre-mixed burners are necessary to provide a uniform coating. However, it is understood that when a flammable mixture of fuel and air or oxygen is present in a gas volume upstream of the combustion zone, a flame can flash back into the gas volume that contains the pre-mixed flammable substances, and there is the possibility of an explosion due to uncontrolled rapid burning of flammable substances. Various mechanisms have been developed to arrest the flame and stop it from burning back up into the nozzle, but for safety reasons, post-mixed burners still tend to be preferred in many applications—even at the cost of performance. In applications where post-mixed burners are used, the limits for size where the nozzle must, for safety reasons, be kept are too small for many industrial applications, especially in the field of surface treatment devices.

SUMMARY

An object of the present invention is thus to provide a burner configuration that provides a pre-mixed burner with the level of safety that is closer to level of safety of a post-mixed burner and with a good surface treatment efficiency. The object of the invention is achieved by a burner nozzle, a burner, and a surface treatment device, which are characterized by what is stated in the independent claims. The preferred embodiments of the invention are disclosed in the dependent claims.

The invention discloses a nozzle body that includes a slit such that a line passage to the slit opens in an outlet face surface. A plurality of channels is connected to the slit. A group of first channels is connected to a source of oxidizing substance, and a group of second channels is connected to a fuel source. Each of the first channels and second channels has a circumferential passage to the slit at a non-zero distance from the outlet face surface. Furthermore, each of the first channels and second channels is formed to output a directed tubular flow towards a side wall of the slit, or towards one or more circumferential passages in a side wall of the slit.

The invention is based on feeding the oxidizing substance and the fuel separately into a plurality of separate channel jets. The plurality of jets includes two types of jets. One group of jets provides flows of fuel and the other group of jets provides flows of oxidizing substance. The jets are directed to output a directed tubular flow towards one or more circumferential passages in a side wall of the slit, or towards a side wall of the slit such that they collide within the slit, and effectively mix within the slit on their way out to the combustion zone.

The slit is narrow so that the volume of premixed materials in flammable state within the nozzle remains at any time very small. Upstream from the slit, the channels contain only material from the fuel source or from the source of oxidizing material. This means that even if a flame flashback would occur, it would not continue beyond the slit, and therefore could not cause significant damage or explosions.

On the other hand, the depth of the slit enables the fuel and the oxidizing material to mix efficiently such that a pre-mixed combustive fluid enters the combustion zone.

BRIEF DESCRIPTION OF THE DRAWINGS

In the following, embodiments will be described in greater detail with reference to accompanying drawings, in which.

DETAILED DESCRIPTION OF SOME EMBODIMENTS

The following embodiments are exemplary. Although the specification may refer to "an", "one", or "some" embodiment(s), this does not necessarily mean that each such reference is to the same embodiment(s), or that the feature only applies to a single embodiment. Single features of different embodiments may also be combined to provide further embodiments.

In the following, features of the invention will be described with a simple example of a burner architecture in which various embodiments of the invention may be implemented. Only elements relevant for illustrating the embodiments are described in detail. Various implementations of burners, burner nozzles and flame devices comprise elements that are generally known to a person skilled in the art and may not be specifically described herein.

Figure 1:
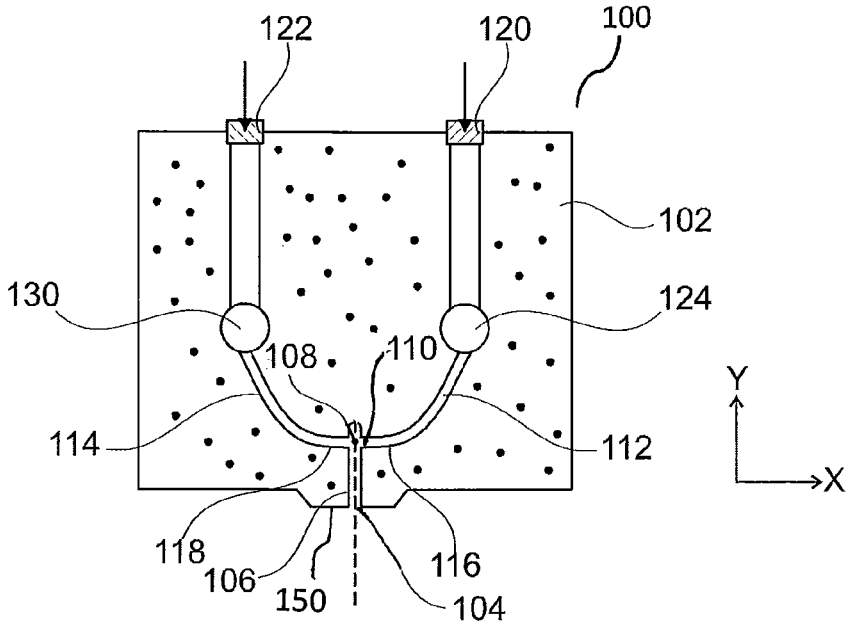
FIG. 1 illustrates a side end view of a burner nozzle.
Figure 2:
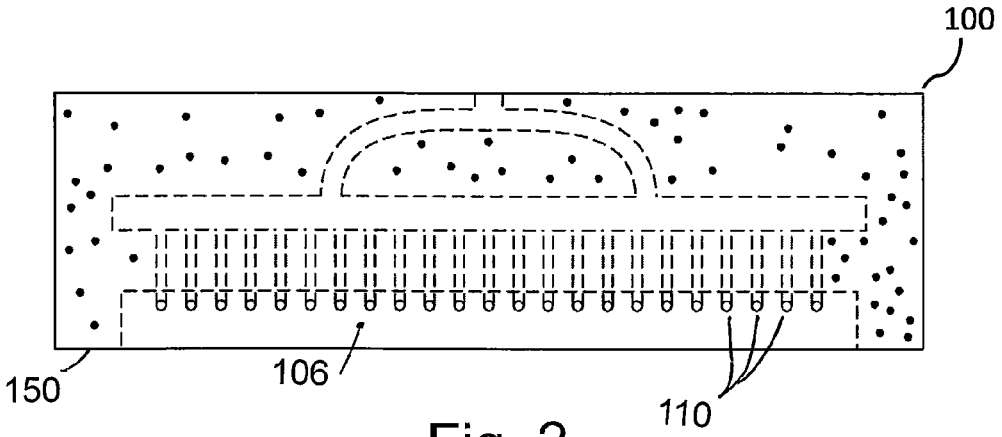
FIG. 2 illustrates a side front view of a burner nozzle.
Figure 3:
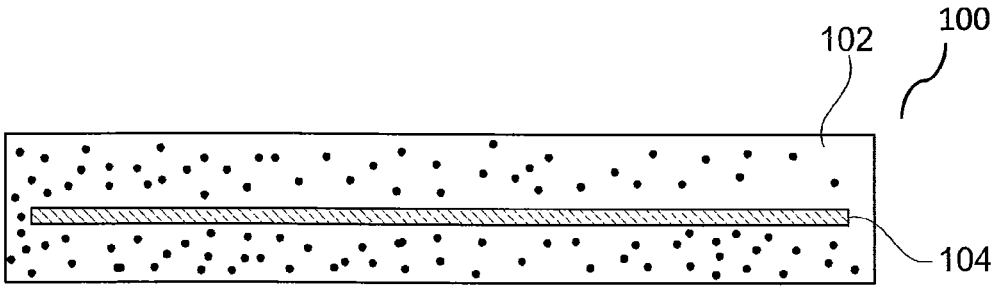
FIG. 3 illustrates a view of a burner nozzle towards the outlet face surface.

FIG. 1 illustrates a side end view, FIG. 2 illustrates a side front view and FIG. 3 an outlet face view of an embodiment of a burner nozzle. The burner nozzle 100 includes a nozzle body 102 that incorporates a variety of channels through which fluids may flow during operation of the burner. Advantageously the nozzle body 102 is a solid volume, preferably of some ceramic material, that includes hollows for channels necessary for the designed nozzle operation. However, the nozzle body 102 may be implemented otherwise without deviating from the scope of protection. For example, a hollow casing that encloses channel pipes may be applied.

The nozzle body 102 includes a slit 106 that ends into a line passage (also called nozzle outlet) 104 opening in an outlet face surface 150 of the nozzle body 102. The term slit refers here to a long narrow space within a volume, i.e. an opening that has an elongate cross section where the length of the cross section is at least five times the width of the cross section, and has a non-zero depth. In FIG. 1, the slit 106 is seen from a side that shows its width and its depth within the nozzle body 102. FIG. 3 illustrates the length of the slit by showing the line passage 104 of the slit in the outlet face surface 150 of the nozzle body 102. The line passage 104 is preferably linear, but other non-linear forms may be applied, as well. For example, a wave-like form may be applied to the slit 106 and/or to the line passage 104. The slit 106 provides a plane-like continuous space through which fluids may through the circumferential passages 110 (only three circumferential passages marked for brevity in FIG. 2) flow during operation of the burner, as shown in FIG. 2. A combustion zone begins from the line passage 104 and during operation, the fluids shooting out of the nozzle tend to form a continuous planar flame curtain aligned with the form of the slit 106.

The intensity of this type of optimally burning continuous flame curtain is very high. The structure effectively reduces atmospheric secondary streams that tend to lower the temperature of the combustion, and potentially cause impurities and particle agglomeration in conventional nozzle configurations.

As shown in FIG. 1, the slit 106 extends to a non-zero depth from the outlet face surface 150 into the nozzle body 102. There are a plurality separate channels that connect to the slit via circumferential passages 110 arranged to the side walls of the slit 106. The term circumferential means here that a perimeter of a circumferential passage is closed to pass out a tubular flow of fluids. The perimeter is advantageously circular, but other forms may be applied, as well. In the plurality of separate channels, a group of first channels 112 is connected to a source or sources of oxidizing substance 120 and a group of second channels 114 is connected to a fuel source or sources 122. The circumferential passage 110 of each of the first channels and second channels has a non-zero distance to the outlet face surface 150 of the nozzle body 102. In FIG. 1, only circumferential passage 110 related to channel 112 is marked for brevity.

In the exemplary embodiment of FIG. 1, circumferential passages of the first channels 112 and circumferential passages of the second channels 114 are arranged to the length of the slit 106 in pairs such that the channels are directly opposite to each other. The distance from the outlet face surface 150 of the nozzle body 102 to the circumferential passage of a first channel 112 of the pair is thus the same as the distance from the outlet face surface 150 to the circumferential passage of a second channel 114 of the pair. The first channel 112 and the second channel 114 of the pair are directed opposite to each other to output a directed tubular flow directly against a directed tubular flow of the opposite channel of the pair. The flows from first channels and from the second channels collide at a depth of the slit where the circumferential passages are positioned. This point is thus called a point of collision 108.

At the point of collision 108 a jet of oxidizing substance from the first channel 112 of a pair and a jet of fuel from the second channel 114 of the pair are made to collide. This may be accomplished by arranging a section 116 of the first channel 112 beginning from the slit 106 and a section 118 of the second channel 114 beginning from the slit 106 to be at least partly opposite to each other. FIG. 1 illustrates an advantageous arrangement where the sections 116, 118 are linear and form a 180 degree angle to be completely opposite to each other.

It is understood that when the jets collide in the point of collision, they very efficiently mix with each other. The mixing will continue in the narrow slit 106 on the way towards the nozzle outlet face surface 150. As a result, during operation, a premixed jet of combustion material flows out of the nozzle outlet (also called line passage) 104. However, if the flame for one reason or another should burn into the slit 106, the volume of readily combustible material in it is very small, and no exposition or essential damage can be caused. The flame will shut down, latest at the point of collision 108. Tests have shown that a very effective premixed-type flame may be achieved in a safe manner. The desired improvement is a result of collisions of directed tubular jets to each other or to side walls of the slit.

According to an embodiment of the invention, it is advantageous to arrange the circumferential passages of the group of first channels 112 to have the same distance to the outlet face surface 150 of the nozzle body, and to have the distance from the outlet face surface 150 of the nozzle body 102 to the circumferential passages of the group of first channels 112 to be at least five times the distance from the closed, bottom end of the slit 106 to the circumferential passages of the group of first channels 112. Similarly, according to another embodiment of the invention, it is advantageous to arrange the circumferential passages of the group of second channels 114 to have the same distance to the outlet face surface 150 of the nozzle body 102, and to have the distance from the outlet face surface 150 of the nozzle body 102 to the circumferential passages of the group of second channels 114 to be at least five times the distance from the closed, bottom end of the slit 106 to the circumferential passages of the group of second channels 114.

Figure 4A:
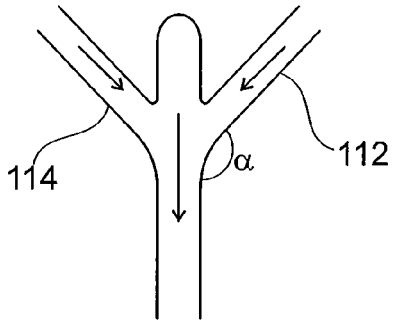
FIGS. 4A and 4B illustrate alternative configurations for circumferential passages and channels to the slit.
Figure 4B:
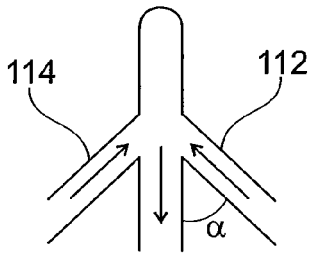

FIGS. 4A and 4B illustrate details of alternative configurations for the circumferential passages and the channels 112, 114 as seen from the side end. In this projection, the circumferential passages appear simply as openings of channels 112 and 114 into the slit. Also in these embodiments, circumferential passages of the first channels 112 and circumferential passages of the second channels 114 are arranged into pairs wherein the distance from the outlet face surface 150 of the nozzle body 102 to a circumferential passage of a first channel 112 of the pair is the same as the distance from the outlet face surface 150 to a circumferential passage of a second channel 114 of the pair, and the pairs are in opposite positions in opposite sides of the slit. However, the first channel 112, the second channel 114, or both of the first and second channels of the pair is configured to output into the slit 106 a directed tubular flow such that the direction of the tubular flow forms an angle with the direction of the depth of the slit. For conciseness, FIGS. 4A and 4B illustrate only the top end of the slit 106. In FIG. 4A the direction of the tubular flow from the first channel 112 and from the second channel 114 is configured to form an obtuse angle α with the direction of the depth of the slit, and in FIG. 4B the direction of the tubular flow from the first channel 112 and from the second channel 114 is configured to form an acute angle α with the direction of the depth of the slit.

Figure 5A:
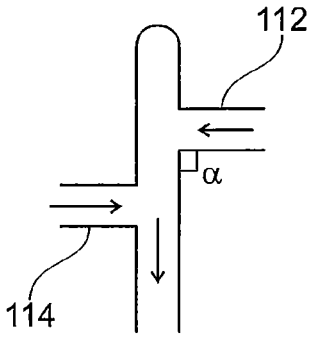
FIGS. 5A to 5C illustrate further alternative configurations for circumferential passages and channels to the slit.
Figure 5B:
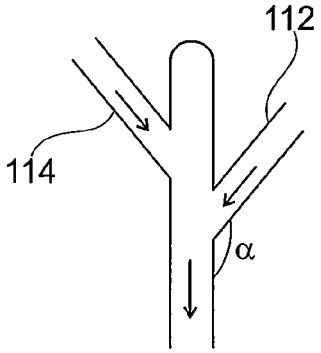
Figure 5C:
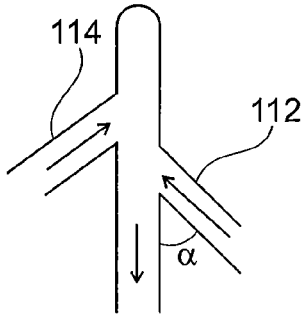

FIGS. 5A to 5C illustrate details of further alternative configurations for the circumferential passages and the channels 112, 114 seen from the side end. Also in this projection, the circumferential passages appear simply as openings of channels 112 and 114 into the slit. In these embodiments, the distance from the outlet face surface to a circumferential passage of a first channel of the pair is different from the distance from the outlet face surface to a circumferential passage of a second channel of the pair, but the circumferential passages of the pairs are on opposite sides along the length of the slit. The first channel 112, the second channel 114, or both of the first and second channels of the pair is configured to output into the slit 106 a directed tubular flow through their respective circumferential passages, wherein the direction of the tubular flow forms an angle with the direction of the depth of the slit 106. For conciseness, also FIGS. 5A to 5C illustrate only the top end of the slit 106. In FIG. 5A the direction of the tubular flow from the first channel 112 and from the second channel 114 is configured to form a right angle α with the direction of the depth of the slit. In FIG. 5B the direction of the tubular flow from the first channel 112 and from the second channel 114 is configured to form an obtuse angle α with the direction of the depth of the slit. In FIG. 5C the direction of the tubular flow from the first channel 112 and from the second channel 114 is configured to form an acute angle α with the direction of the depth of the slit.

Figure 6A:
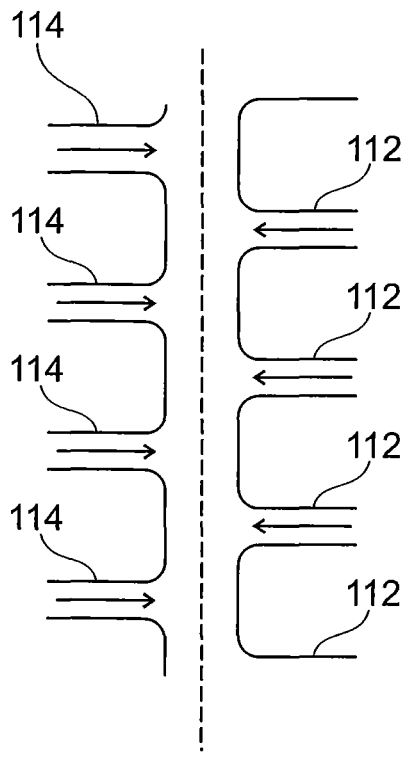
FIGS. 6A and 6B illustrate further alternative configurations for circumferential passages and channels to the slit.
Figure 6B:
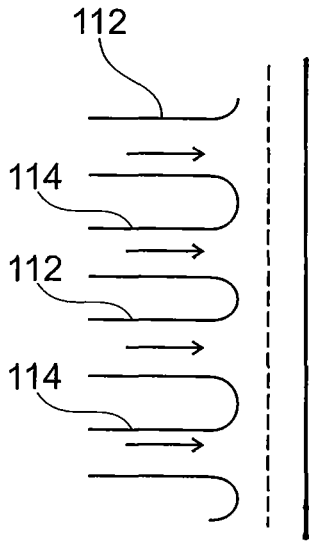

FIGS. 6A and 6B illustrate further alternative configurations for the circumferential passages and the channels 112, 114. FIGS. 6A and 6B show a top view of a section of the slit 106. Also in this projection, even though different from FIGS. 4A to 5C, the circumferential passages appear simply as openings of channels 112 and 114 into the slit. In the embodiments, circumferential passages of the first channels 112 and circumferential passages of the second channels 114 are arranged again to the length of the slit 106 in pairs such that the distance from the outlet face surface to a circumferential passage of a first channel 112 of the pair is the same as the distance from the outlet face surface to a circumferential passage of a second channel 114 of the pair. In the embodiment of FIG. 6A, circumferential passages of the first channels 112 and second channels 114 are, however, arranged to interdigitated positions along the length of the slit in the opposite sides of the slit 106. The first channels 112 and the second channels 114 are thereby configured to output, through their respective circumferential passages, a directed tubular flow towards and against opposite side walls of the slit 106. On the other hand, in the embodiment of FIG. 6B, the circumferential passages of the first channels 112 and second channels 114 are arranged to interdigitated positions in one side wall of the slit 106. By means of this they are configured to output a directed tubular flow towards and against the opposite side wall of the slit 106.

Figure 7:
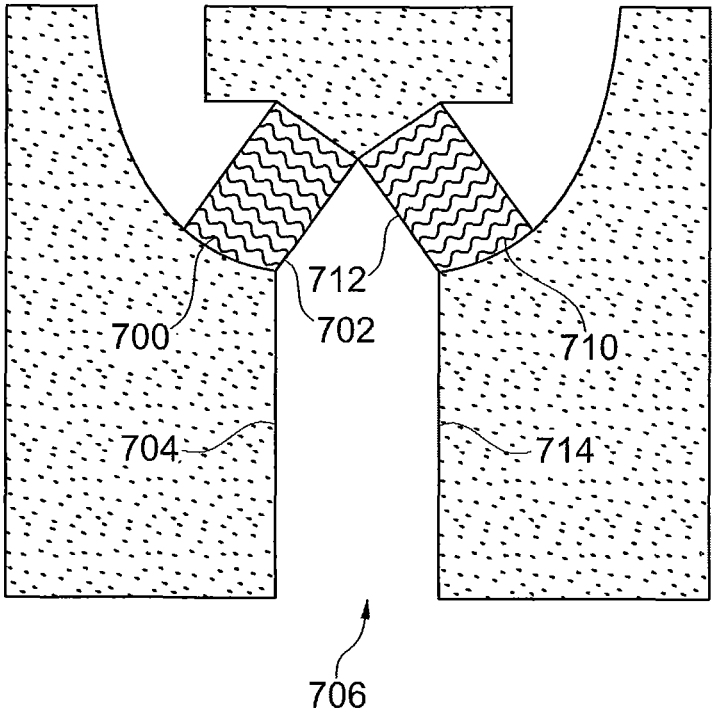
FIG. 7 illustrates a further configuration that applies pieces of porous material.

FIG. 7 illustrates a further configuration where the first channels 112 and the circumferential passages of the first channels 112 are provided by pores of a first piece of porous material 700. A surface 702 of the first piece of porous material may form a part of a first side wall 702, 704 of the slit 706. Correspondingly, the second channels 114 and the circumferential passages of the second channels 114 may be provided by pores of a second piece of porous material 710. A surface 712 of the second piece of porous material may form a part of a second side wall 712, 714 of the slit 706. The pores of the pieces of porous material 700, 710 thus output minuscule jets of oxidizing and fuel fluids. Jets from the first piece of porous material 700 collide with the jets from the second piece of porous material 710, or with the surface 712 of the second piece of porous material 710, and vice versa. Some jets may collide even with ends of the remaining part 704, 714 of the side wall of the slit 706.

The surface 702 that forms the part of the first side wall may be directly opposite to the surface 712 that forms the part of the second side wall. Alternatively surface 702 that forms the part of the first side wall and the surface 712 that forms the part of the second wall may be configured to form sides of an angle. In the exemplary configuration of FIG. 7, the surfaces 702, 712 form an acute angle, the vertex of which coincides with the end of the slit 706.

Returning back to FIGS. 1, 2 and 3, the source of oxidizing substance 120 and the fuel source 122 are illustrated with an input mechanism that can be connected to an external reservoir of volatile materials. The plurality of pairs of the first channels and of the second channels may form two strings of channel inlets. These strings may extend symmetrically to the length of the slit 106. In the nozzle body 102, the source of oxidizing substance may be connected to a first elongate gas space 124 that extends essentially to the length of the slit 106, and be connected to the string of first channel 112 inlets. Advantageously, the first elongate gas space 124 extends parallel to and to the whole length of the string of first channel 112 inlets. The continuous gas space serves then to balance pressures of the input volatile materials such that the oxidizing substance enters the first channels 112 at the same pressure along the whole length of the first elongate gas space 124. Advantageously, in order to further promote equalization of the pressure, the first elongate gas space 124 may be connected to the source of oxidizing substance 120 with two or more feed channels spaced apart from each other.

Correspondingly, the fuel source 122 may be connected to a second elongate gas space 130 that extends essentially to the length of the slit 106, and is connected to the string of second channel 114 inlets. Advantageously, the second elongate gas space 130 extends parallel to and to the whole length of the slit 106. Furthermore, the second elongate gas space 130 may be connected to the fuel source 122 with two or more feed channels, spaced apart from each other.

As discussed above, the collision of jets from the first channel and the second channel occurs at a point of collision 108. In order to facilitate appropriate opposite position of the first and second channel sections 116, 118, the first and second elongate gas spaces 124, 130 need to be offset from the slit 106. Advantageously one or each one of the elongate gas spaces 124, 130 has a linear form, and the cross section of the elongate gas space is point symmetrical around a centre point. For collision, the centre line along the length of the gas space may have a non-zero distance to the slit 106, both in the horizontal x-direction as well as in the vertical y-direction, as shown in FIG. 1. Advantageously, the structure is symmetrical such that the offset of the first gas space 124 from the slit 106 in x-direction (direction perpendicular to the direction of the slit 106) is the same as the offset of the second gas space 130 from the slit 106. Similarly, the offset of the first gas space 124 from the outlet face surface 150 in the y-direction may be the same as the offset of the second gas space 130 from the outlet face surface 150. In other words, the first elongate gas space 124 and the second elongate gas space 130 are equally offset from the slit 106.

At least part of the first channel 112 or the second channel 114 may have a convergent form, where a narrower cross-section of a channel is in the end of the slit 106. The convergent form of the flow channel increases the velocity of the jet of volatile material within the channel. The convergent form of the channels may thus be used to intensify the collision of the jets and thereby ensure efficient mixing at the point of collision 108. Alternatively, the cross section of the section 116 of the first channel 112 beginning from the slit 106, or the cross section of the section 118 of the second channel 114 beginning from the slit 106 constant.

The invention may be applied for various types of burners, but it is specifically useful for high firing rate burners, for example for oxy-fuel burners that apply oxygen or ozone as the oxidizing substance. In such burners, pre-mixed combustion is not commonly used in industrially applicable dimensions because of safety reasons. By means of the present invention, a premixed combustion may be achieved with improved safety level.

Figure 8:
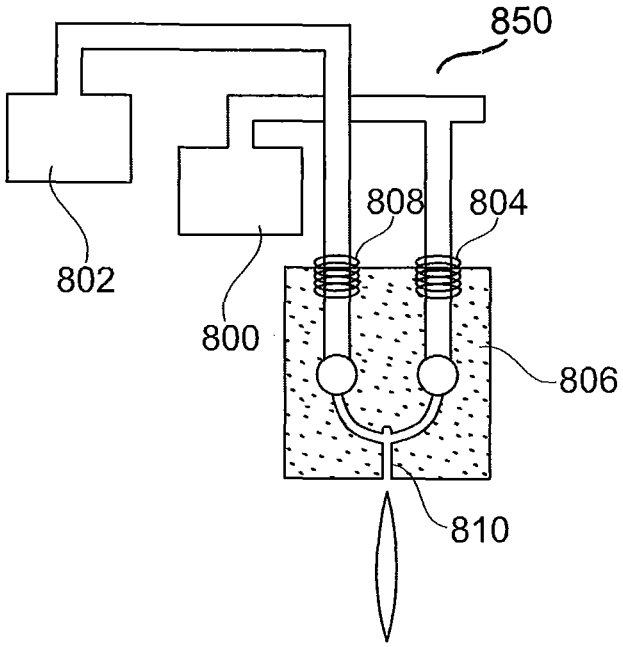
FIG. 8 illustrates an embodiment of a burner that incorporates the burner nozzle.

FIG. 8 illustrates an embodiment of a burner 850 that incorporates the burner nozzle of FIGS. 1 to 3. The burner 850 includes a first reservoir 800 that acts as a source of oxidizing substance, and a second reservoir 802 that acts as a fuel source. The first reservoir is connected to a first input interface 804 in the nozzle body 806, and the second reservoir 802 is connected to a second input interface 808 in the nozzle body 806. The input fluids flow separately within the nozzle until they reach the slit 810, where they mix into a combustible material, and flow out of the nozzle outlet giving rise to a flame as described above. Due to the efficient mixing in the point of collision, the flame curtain is intensive and moreover, the intensity is very similar and uniform in different parts of the flame curtain.

The burner 850 of FIG. 8 may be applied for various purposes. For example, the fuel of oxidizing substances may be selected, or prepared to include precursor chemicals that, when exposed to the heat of the flame, go through a particle synthesis process. The produced particles may be driven against a substrate allowing particles to diffuse in the substrate matrix, or deposit on the surface such that a surface layer is produced on the substrate for any surface treatment purpose.

Figure 9:
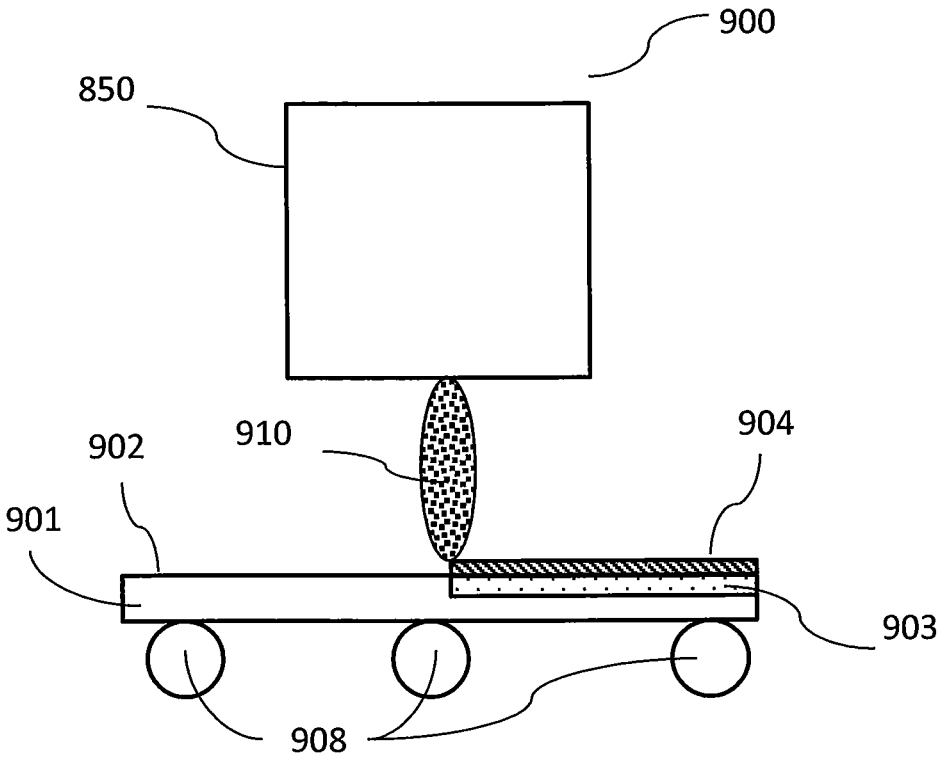
FIG. 9 illustrates an embodiment of a surface treatment device that incorporates a burner incorporating the burner nozzle.

A surface treatment device 900 of FIG. 9 incorporates a burner 850 of FIG. 8. In operation, burner 850 shoots out a flame 910 that modifies the surface 902 of a substrate 901 into a modified surface 903 (thickness of the modification not in scale), or alternatively or in addition, grows one or more layers of material 904 (thickness of the layer or layers not in scale) on the surface 902. The burner 850 and the substrate are set into relative motion allowing the burner 850 and the flame 910 to treat the substrate in various areas of the substrate. The relative motion can be effectuated for example by using rollers 908 to move the substrate relative to the burner. Alternatively or in addition, the burner can be moved and the substrate can be held still. Substrate can be a continuous substrate (e.g. a glass in a float glass process) or a discontinuous substrate (e.g. a rectangular glass sheet). Substrate can also be a non-planar substrate, e.g. some 3D shape. Substrate can comprise e.g. glass, cardboard, paper, ceramics or metal.

In FIGS. 1, 8 and 9, the burner is held in a position that makes the flame shoot out in a vertical downward direction. However, the burner can be oriented in any direction e.g. to create a horizontal flame, or a flame that shoots directly upwards, or in any other angle relative to horizontal or vertical directions.

Some precursor materials have a tendency to start creating agglomerated particles in low temperatures when they get exposed to oxygen. Prematurely created large particles are typically not applicable for the desired purpose of the combustion-induced process, and in conventional premixed burners, such materials have been problematic. If the particle generation begins already during premixing, the generated particles tend to clog the channels and uncontrollably increase the risk of explosions. With the configuration of the present invention, the particle agglomeration takes place very late, just before the nozzle outlet. As a further advantage, the amount of undesired particles may thus be significantly reduced. This means that a variety of substances that could not be applied by means of conventional pre-mixed burners may be applied safely with the claimed configuration.

It will be obvious to a person skilled in the art that, as technology advances, the inventive concept can be implemented in various ways. For example, as clear to a person skilled in the art, the length, width and the depth need to be adjusted according to the applied fluids and jet velocities. The length of the slit must, however, be at least five times the width of the slit. In high firing-rate applications, the length of the slit can, within tolerances, be extended to at least fifty times the width of the slit. This means that very wide flame curtain can be achieved even with these difficulty controllable substances. It has been further detected that a very consistent intensity can be achieved when the distance between two successive circumferential passages in a side wall of the slit is one third or less than the depth of the slit. Advantageously, in the high firing-rate burners, the size of the slit should be smaller than 200 square millimeters.

It is essential that at least the first channels and second channels are configured to mix in their respective points of collision. For a person skilled in the art it is, however, clear that the nozzle body may include one or more further channels for volatile materials, leading to the point of collision. Such additional channels may be used, for example, to include more precursor materials to the process that takes place in the thermal reactor of the combusting materials. As another example, such additional channels may be used to lead to the mixture controllable amounts of combustion control substances. Additional channels may be used for a variety of further purposes within the scope of protection.

The invention and its embodiments are not limited to the examples described above but may vary within the scope of the claims.

The invention claimed is:

1. A burner nozzle (100) that comprises:

a nozzle body (102) that includes a slit (106), a line passage (104) to the slit opening in an outlet face surface (150);

a plurality of channels (112,114) connected to the slit (106), characterized in that a group of first channels (112) is connected to a source of oxidizing substance (120), and a group of second channels (114) is connected to a fuel source (122);

each of the first channels (112) and second channels (114) have a circumferential passage (110) to the slit at a non-zero distance from the outlet face surface (150);

each of the first channels (112) and second channels (114) is formed to output a directed tubular flow towards a side wall of the slit (106), or towards one or more circumferential passages (110) in a side wall of the slit (106).

2. A burner nozzle (100) according to claim 1, characterized in that circumferential passages of the first channels (112) and circumferential passages of the second channels (114) are arranged to the length of the slit (106) in pairs wherein the distance from the outlet face surface (150) to a circumferential passage of the first channel (112) of the pair is the same as the distance from the outlet face surface (150) to a circumferential passage of the second channel (114) of the pair; and the first channel (112) and the second channel (114) of the pair are directed opposite to each other to output a directed tubular flow directly against a directed tubular flow of the opposite channel of the pair.

3. A burner nozzle (100) according to claim 1, characterized in that circumferential passages of the first channels (112) and circumferential passages of the second channels (114) are arranged into pairs wherein the distance from the outlet face surface (150) to a circumferential passage of the first channel (112) of the pair is the same as the distance from the outlet face surface (150) to a circumferential passage of the second channel (114) of the pair, and the circumferential passages of the pairs are in opposite positions in opposite sides of the slit (106); and the first channel (112), the second channel (114), or both of the first and second channels (112,114) of the pair is configured to output into the slit (106) a directed tubular flow, wherein the direction of the tubular flow forms an obtuse or acute angle with the direction of the depth of the slit (106).

4. A burner nozzle (100) according to claim 1, characterized in that circumferential passages of the first channels (112) and circumferential passages of the second channels (114) are arranged into pairs wherein the distance from the outlet face surface (150) to a circumferential passage of the first channel (112) of the pair is different from the distance from the outlet face surface (150) to a circumferential passage of the second channel (114) of the pair, and the circumferential passages of the pairs are in opposite positions along the length of the slit (106); and the first channel (112), the second channel (114), or both of the first and second channels (112, 114) of the pair is configured to output into the slit a directed tubular flow, wherein the direction of the tubular flow forms a right, obtuse or acute angle with the direction of the depth of the slit.

5. A burner nozzle (100) according to claim 1, characterized in that circumferential passages of the first channels (112) and circumferential passages of the second channels (114) are arranged to the length of the slit (106) in pairs wherein the distance from the outlet face surface (150) to a circumferential passage of the first channel (112) of the pair is the same as the distance from the outlet face surface (150) to a circumferential passage of the second channel (114) of the pair; and the first channels (112) and second channels (114) are arranged to interdigitated positions in the opposite sides of the slit (106) to output a directed tubular flow against opposite side walls of the slit (106).

6. A burner nozzle (100) according to claim 1, characterized in that circumferential passages of the first channels (112) and circumferential passages of the second channels (114) are arranged to the length of the slit (106) in pairs wherein the distance from the outlet face surface (150) to a circumferential passage of the first channel (112) of the pair is the same as the distance from the outlet face surface (150) to a circumferential passage of the second channel (114) of the pair; and the first channels (112) and second channels (114) are arranged to interdigitated positions in one side of the slit (106) to output a directed tubular flow against the opposite side wall of the slit (106).

7. A burner nozzle (100) according to claim 1, characterized in that circumferential passages of the first channels are provided by a first piece of porous material (700), a surface (702) of the first piece of porous material (700) forming a part of a first side wall (702, 704) of the slit (706);

circumferential passages of the second channels are provided by a second piece of porous material (710), a surface (712) of the second piece of porous material (710) forming a part of a second side wall (712, 714) of the slit (706).

8. A burner nozzle (100) according to claim 7, characterized in that the surface (702) of the first piece of porous material part is directly opposite to the surface (712) of the second piece of porous material, or that the surface (702) of the first piece of porous material part and the surface (712) of the second piece of porous material form an acute angle, the vertex of the acute angle coinciding with the end of the slit (706).

9. A burner nozzle (100) according to claim 1, characterized in that the source of oxidizing substance (120) is connected to a first elongate gas space (124) that extends essentially to the length of the slit (106), and is connected to inlets of the first channels (112).

10. A burner nozzle (100) according to claim 9, characterized in that the first elongate gas space (124) or the second elongate gas space (130) is offset from the slit (106) in a direction perpendicular to the slit (106).

11. A burner nozzle (100) according to claim 10, characterized in that the first elongate gas space (124) and the second elongate gas space (130) are equally offset from the slit (106).

12. A burner nozzle (100) according to claim 9, characterized in that the first elongate gas space (124) or the second elongate gas space (130) has a linear form.

13. A burner nozzle (100) according to claim 1, characterized in that the fuel source (122) is connected to a second elongate gas space (130) that extends essentially to the length of the slit (106), and is connected to inlets of the second channels (114).

14. A burner nozzle (100) according to claim 1, characterized in that the circumferential passages of the group of first channels (112) have the same distance to the outlet face surface (150);

the distance from the outlet face surface (150) to the circumferential passages of the group of first channels (112) is at least five times the distance from the closed, bottom end of the slit (106) to the circumferential passages of the group of first channels (112).

15. A burner nozzle (100) according to claim 1, characterized in that the circumferential passages of the group of second channels (114) have the same distance to the surface (150) of the nozzle body;

the distance from the outlet face surface (150) to the circumferential passages of the group of second channels (114) is at least five times the distance from the closed, bottom end of the slit (106) to the circumferential passages of the group of second channels (114).

16. A burner nozzle (100) according to claim 1, characterized in that at least part of the first channels (112) or the second channels (114) have a convergent form, a narrower cross-section of a channel being in the end of the slit (106).

17. A burner nozzle (100) according to claim 16, characterized in that the cross section of a section (116) of the first channel (112) beginning from the slit (106), or the cross section of the section (118) of the second channel (114) beginning from the slit (106) is constant.

18. A burner nozzle (100) according to claim 1, characterized in that the first elongate gas space (124) and the second elongate gas space (130) have a linear form that extends parallel to and to the whole length of the slit (106).

19. A burner nozzle (100) according to claim 18, characterized in that the first elongate gas space (124) has two or more gas inputs to the source of oxidizing substance (120) and the second elongate gas space (130) has two or more gas inputs for the fuel source (122).

20. A burner nozzle (100) according to claim 1, characterized in that the oxidizing substance is oxygen.

21. A burner (850), characterized by comprising a burner nozzle (100) according to claim 1.

22. A surface treatment device (900), characterized by comprising a burner (850) according to claim 21.

* * * * *